US005295542A

United States Patent [19]

Cole et al.

[11] Patent Number: 5,295,542

[45] Date of Patent: Mar. 22, 1994

[54] WELL GRAVEL PACKING METHODS

[75] Inventors: R. Clay Cole; John A. Knox, both of Duncan, Okla.

[73] Assignee: Halliburton Company, Duncan, Okla.

[21] Appl. No.: 956,512

[22] Filed: Oct. 5, 1992

[51] Int. Cl.[5] ..... E21B 43/04

[52] U.S. Cl. ..... 166/278

[58] Field of Search ..... 166/50, 51, 276, 278

[56] References Cited

U.S. PATENT DOCUMENTS

| | | | |
|---|---|---|---|
| 2,349,062 | 5/1944 | Uren | 166/278 |
| 3,498,380 | 3/1970 | Sparlin et al. | 166/278 |
| 4,553,595 | 11/1985 | Huang et al. | 166/50 X |
| 4,660,642 | 4/1987 | Young | 166/280 |
| 4,669,543 | 6/1987 | Young | 166/276 |
| 4,796,701 | 1/1989 | Hudson et al. | 166/278 |
| 4,850,430 | 7/1989 | Copeland et al. | 166/276 |
| 4,969,523 | 11/1990 | Martin et al. | 166/278 |

OTHER PUBLICATIONS

Paper entitled "Use of Low-Density, Gravel-Pack Material Improves Placement Efficiency (Part 2)" by T. E. Hudson and J. W. Martin, SPE 18227, presented at the 63rd Annual Technical Conference and Exhibition of the Society of Petroleum Engineers held in Houston, Texas, Oct. 2-5, 1988.

*Primary Examiner*—George A. Suchfield

*Attorney, Agent, or Firm*—Clark Dougherty, Jr.; Robert A. Kent

[57] ABSTRACT

Improved methods of placing a gravel pack in a wellbore and in one or more perforations extending from the wellbore into a producing zone are provided. The methods basically comprise the steps of placing a screen in the wellbore adjacent the perforations, and then injecting a low viscosity carrier liquid having a particulate solid pack material suspended therein into the space between the screen and the walls of the wellbore containing the perforations. The pack material has a specific gravity substantially the same as the specific gravity of the carrier liquid whereby a low viscosity carrier liquid can be utilized and the carrier liquid-pack material suspension contains a high loading of pack material.

20 Claims, No Drawings

WELL GRAVEL PACKING METHODS

BACKGROUND OF THE INVENTION

1. Field of the Invention

The present invention relates to well gravel-packing methods, and more particularly, to improved methods of forming gravel packs in vertical and nonvertical wellbores.

2. Description of the Prior Art

The gravel packing of wellbores and perforations extending therefrom into subterranean producing zones has been practiced in the oil field for many years. Such gravel packing involves the placement of a tightly packed mass of particulate solid material in the wellbore and perforations extending therefrom so that loose or incompetent subterranean formation materials produced with hydrocarbons are screened out by the gravel pack and are prevented from entering the wellbore.

A gravel pack is typically formed in a wellbore by placing a tubular gravel pack screen in the wellbore adjacent the perforations therein and then injecting a carrier liquid having a particulate solid pack material suspended therein into the space between the exterior of the screen and the walls of the wellbore containing the perforations. The pack material which has heretofore typically been sand or bauxite, is screened out of the carrier liquid and a pack of the material is formed in the perforations and in the annular space between the screen and the wellbore walls. An alternate technique involves injecting a carrier liquid-pack material suspension into the wellbore and into the perforations whereby the perforations are packed and then setting the screen and packing the annulus using the same or different carrier liquid-pack material suspension.

A problem which has continuously been associated with gravel packing procedures, particularly in nonvertical wellbores, is that the pack material settles out of the carrier liquid and does not enter one or more of the perforations. This results in unpacked perforations and voids in the gravel pack which allows the production of fines and sand with produced fluids when the well is placed on production.

In horizontal wells, i.e., wells that are drilled and completed with the portion of the wellbore in the producing formation or zone positioned substantially horizontally, the perforated horizontal portion of the wellbore can be very long. In gravel packing such horizontal wellbore sections, the pack material often settles to the bottom of the horizontal wellbore as the carrier liquid-pack material suspension flows therethrough resulting in voids in the gravel pack as well as unpacked perforations positioned in the top of the wellbore.

It is known that the transport of pack material such as sand without settling over a long nonvertical distance requires either a viscosified carrier liquid or very large volumes of a low viscosity carrier liquid, e.g., brine. High viscosity carrier liquids having sand suspended therein have not provided the degree of perforation and annulus packing needed to prevent gravel pack voids. On the other hand, low viscosity carrier liquid suspensions of sand have shown good packing efficiency in horizontal wellbores, but the sand loading of the suspension must be low which results in large volumes of the carrier liquid entering the production zone by way of the perforations. This in turn often results in considerable damage to the producing zone as a result of, for example, the swelling or migration of formation clays and fine material.

Thus, there is a need for an improved gravel packing method featuring the use of a low viscosity carrier liquid, such as brine, containing a high loading of pack material. Such a carrier liquid-pack material suspension would allow the pack material to be transported long distances in wellbores without settling, would form tight and uniform gravel packs and would limit fluid lost into the formations to thereby minimize damage to producing formations.

SUMMARY OF THE INVENTION

By the present invention, improved well gravel packing methods are provided which overcome the shortcomings of the prior art and meet the need described above. In accordance with the methods, a gravel pack is produced in a wellbore and in one or more perforations extending from the wellbore into a producing formation or zone penetrated thereby. A low viscosity carrier liquid having a particulate solid pack material suspended therein is injected into the perforations whereby packs of the material are separated out of the carrier liquid and formed in the perforations. A tubular gravel pack screen can be placed in the wellbore before or after the perforations are packed, and the same or a different carrier liquid-pack material suspension can be injected in the annular space between the exterior of the screen and the walls of the wellbore to complete the formation of the gravel pack therein.

The pack material utilized in accordance with this invention has a specific gravity substantially the same as the specific gravity of the carrier liquid thereby allowing the suspension to be pumped long distances in wellbores without appreciable settling and also permitting a high loading of pack material. Once the gravel pack has been formed, the carrier liquid is recovered from the wellbore and producing formation by producing the well.

It is, therefore, a general object of the present invention to provide improved well gravel packing methods.

A further object of the present invention is the provision of improved gravel packing methods which are useful in gravel packing both vertical and nonvertical wellbores.

Other and further objects, features and advantages of the present invention will be readily apparent to those skilled in the art upon a reading of the description of preferred embodiments which follows.

DESCRIPTION OF PREFERRED EMBODIMENTS

In well gravel packing procedures utilized heretofore, relatively high specific gravity particulate solid pack material, e.g., graded sand or bauxite, has been utilized. In order to carry such high specific gravity pack material into the zone within the wellbore to be packed, at least part of the pack material has been suspended in viscosified carrying liquids. Conventional high viscosity carrier liquid-high specific gravity pack material suspensions have been used successfully in forming gravel packs in vertical wellbores because settlement of the suspended pack material in the carrier liquid generally does not prevent a tight uniform gravel pack from being formed.

In gravel packing nonvertical wellbores, i.e., wellbores in which the perforated production portion is inclined or horizontal, the use of viscosified carrier liquid-high specific gravity pack material suspensions generally does not result in the formation of 100% efficiency gravel packs. That is, the high viscosity of the carrier liquid in combination with the settlement of pack material prior to being placed may result in large voids being left at the upper portions of the pack which in turn depletes the perforations of pack material when the well is produced. The final result is that incompetent fines and sand from the producing formation migrate with produced fluids into the wellbore.

When the carrier liquid utilized for forming gravel packs in wellbores has a low viscosity, better results are obtained, but the loading of the carrier liquid with pack material must be low in order to carry the pack material through the wellbore without excessive settling. Consequently, large volumes of the carrier liquid are injected into the producing formation or zone during placement of the pack which can and often does cause considerable damage to the producing formation or zone. That is, the presence of the low viscosity carrier liquid in the formation or zone can alter the wettability of the formation or zone or cause clays contained therein to swell or migrate and reduce the formation or zone permeability. Also, the presence of large volumes of the low viscosity carrier liquid in low pressure formations or zones can cause the production of hydrocarbons therefrom to be choked off.

The improved method of the present invention features the combination of a low viscosity carrier liquid and a particulate solid pack material wherein the carrier liquid and pack material each have about the same specific gravity. This permits a suspension of the pack material in the low viscosity carrier liquid to be pumped through nonvertical wellbores without substantial settling. A further advantage of the carrier liquid and pack material each having about the same specific gravity is that if high carrier liquid losses to surrounding permeable formations takes place during placement of the gravel pack whereby the pack material is prematurely deposited, additional carrier liquid flowing through the wellbore will lift and carry the pack material to the desired location. The slurries prepared herein using the materials having the above described properties have high particulate loading wherein the carrier liquid volume occupies in the range of from about 101 to about 120% and preferably from about 101 to about 110% of the available void space between touching pack material particles.

In accordance with the improved methods of the present invention for placing a gravel pack in a wellbore and in one or more perforations extending from the wellbore into a producing zone, a low viscosity carrier liquid having a particulate solid pack material of about the same specific gravity suspended therein is injected into the perforations. As the carrier liquid flows into and through the perforations, the pack material is separated out of the carrier liquid and gravel packs are formed in the perforations. A gravel pack screen is placed in the wellbore adjacent the perforations therein either before or after the perforations are packed. Such a screen is tubular and has an effective diameter less than the diameter of the wellbore. The continued injection of the same or different carrier liquid-pack material suspension into the annular space between the exterior of the screen and the walls of the wellbore containing the perforations causes the pack material to be screened out in the annular space and the gravel pack to be completed therein.

The carrier liquid flowing through the screen remains in the wash pipe or screen interior and the carrier liquid flowing through the perforations enters the producing formation or zone. However, because of the high pack material loading of the carrier liquid-pack material suspension of this invention, only a relatively small quantity of the carrier liquid enters the producing formation or zone prior to the completion of the gravel pack forming process. The carrier liquid in the formation and in the wellbore is then recovered by producing the well.

Carrier liquids which are useful in accordance with the present invention generally have a low viscosity, i.e., a viscosity in the range of from about 0.6 to about 30.0 centipoises, measured at a shear rate of $511^{-1}$ seconds, and have a specific gravity in the range of from about 0.78 to about 2.30 at 20° C. Suitable liquids having such properties can be either Newtonian or non-Newtonian aqueous solutions of salts or mixtures of salts such as sodium chloride, potassium chloride, ammonium chloride, calcium chloride, calcium bromide and zinc bromide. Oil field brines, which may contain polymers and thus can be either gelled or ungelled, are also particularly suitable and are the most preferred in that they are readily available and cause a minimum of damage to most producing formations or zones. However, in formations containing very sensitive clays which swell when contacted with brines or which are otherwise damaged by contact with brines, hydrocarbon carrying liquids of various viscosities can be used.

Particulate solid pack materials which are useful in accordance with the present invention are those materials having specific gravities in the range of from about 0.78 to about 2.03 at 20° C., and which have the other physical properties required for forming suitable gravel packs. Such other properties include high crush resistance, good roundness and good sphericity as well as having a high percent of particles in the desired size range and low solubility in produced fluids and acids. The API standards of acceptance for gravel packing materials as set forth in the *Recommended Practices For Testing Sand used in Gravel Packing Operations*, Recommended Practice 58, 1990 of the American Petroleum Institute are as follows:

| Properties | API Standards of Acceptance |
|---|---|
| Krumbein Roundness | Greater than 0.6 |
| Krumbein Sphericity | Greater than 0.6 |
| % in designated size range | Greater than 96% |
| Solubility in 12% - 3% HCl-HF | Less than 1.0% |
| Fines after 2000 psi crush load | 2.0% or Less |

Of the various materials meeting the above described requirements, plastic materials are particularly suitable. Preferred plastic materials are those comprising a resin selected from the group consisting of a polymer or copolymer of acrylic acid, methacrylic acid, esters of such acids and acrylonitrile; polyester; urea-formaldehyde; polyepoxide; melamine-formaldehyde; and styrene-divinylbenzene. The presently most preferred such plastic material is comprised of styrene-divinylbenzene resin having a specific gravity of about 1.13, a density of about 9.42 pounds per gallon, a Krumbein roundness of greater than 0.9 and a Krumbein sphericity of greater than 0.9. In addition, such plastic material is insoluble in 12%-3% HCl-HF and produces no fines after being subject to a 2000 psi crush load. Natural organic materials such as walnut hulls are also useful herein as pack materials.

In carrying out the methods of the present invention, a carrier liquid selected from the group consisting of aqueous solutions of sodium chloride, potassium chloride, ammonium chloride, calcium chloride, calcium bromide, zinc bromide and mixtures of such salts and brines is utilized having a viscosity in the range of from about 0.6 to about 30.0 centipoises measured at a shear rate of $511^{-1}$ seconds, and a specific gravity in the range of from about 0.78 to about 2.30 at 20° C. A plastic pack material having a specific gravity in the range of from about 0.78 to about 2.30 at 20° C. meeting the above listed API standards is suspended in the carrier liquid. Preferred such plastic pack materials are those having a specific gravity in the range of from about 1.1 to about 1.15 at 20° C., most preferably 1.13.

A suspension of carrier liquid-plastic pack material formed with a carrier liquid having a specific gravity in the range of from about 0.78 to about 2.30 at 20° C. and a pack material having a specific gravity in the range of from about 0.78 to about 2.30 a 20° C. generally contains the pack material in an amount in the range of from about 7.5 to about 33.0 pounds of pack material per gallon of carrier liquid. It is evident that different pack materials will result in different weight loading.

The most preferred carrier liquid-pack material suspension for use in accordance with the present invention is comprised of brine having a viscosity of from about 1.2 to about 2.9 centipoises and a specific gravity of about 1.13 at 20° C. containing a pack material comprised of styrene-divinylbenzene resin having a specific gravity of about 1.13 at 20° C. in an amount of from about 12 to about 16 pounds per gallon of carrier liquid.

When the carrier liquid-pack material suspensions of this invention are injected into perforations and into the annular space between the exterior of a gravel pack screen and the walls of a vertical or nonvertical wellbore containing the perforations, a tight uniform gravel pack is quickly screened out and formed in the perforations and annular space with a minimum of carrier liquid entering the producing formation or zone. The carrier liquid is readily recovered from the wellbore and from the producing formation or zone when the well is placed on production.

Thus, the present invention is well adapted to carry out the objects and attain the ends and advantages mentioned as well as those which are inherent therein. While numerous changes may suggest themselves to those skilled in the art, such changes are encompassed within the spirit of this invention as defined by the appended claims.

What is claimed is:

1. An improved method of placing a gravel pack in a wellbore and in one or more perforations extending from the wellbore into a producing zone comprising the steps of:

injecting a low viscosity slurry of a carrier liquid having a particulate solid pack material suspended therein into the portion of said wellbore containing said perforations whereby a gravel pack of high efficiency of said pack material is separated out of said slurry and formed in said perforations and said wellbore, said pack material having a specific gravity substantially the same as the specific gravity of said carrier liquid and at least a portion of said slurry comprises said carrier liquid in a volume in the range of from about 101 to about 120% of the available void space between touching particulate material present in said slurry; and recovering said carrier liquid.

2. The method of claim 1 wherein said carrier liquid and pack material having specific gravities in the range of from about 0.78 to about 2.30 at 20° C. and said pack material is present in said carrier liquid-pack material suspension in an amount in the range of from about 7.5 to about 33.0 pounds of pack material per gallon of carrier liquid and said carrier liquid occupies a volume of from about 101% to 110% of the available void space between touching particulate material.

3. The method of claim 1 which further comprises placing a tubular gravel pack screen in said wellbore adjacent said perforations prior to injecting said carrier liquid having pack material suspended therein into said wellbore and perforations.

4. The method of claim 1 which further comprises placing a tubular gravel pack screen in said wellbore after said gravel pack is formed in said perforations and continuing the injection of the same or different carrier liquid having pack material suspended therein into said wellbore to form additional gravel pack in said wellbore.

5. The method of claim 1 wherein said carrier liquid is selected from the group consisting of hydrocarbon liquids, aqueous solutions of sodium chloride, potassium chloride, ammonium chloride, calcium chloride, calcium bromide, zinc bromide and mixtures of such salts and oil field brines.

6. The method of claim 5 wherein said pack material is selected from one of natural organic substances or a resin selected from the group consisting of a polymer or copolymer of acrylic acid, methacrylic acid, esters of the foregoing acids and acrylonitrile, polyester, urea-formaldehyde, polyepoxide, melamine-formaldehyde and styrene-divinylbenzene.

7. The method of claim 1 wherein said carrier liquid is brine having a specific gravity of from about 1.1 to about 1.15 at 20° C.

8. The method of claim 7 wherein said pack material is comprised of styrene-divinylbenzene having a specific gravity of from about 1.1 to about 1.15.

9. The method of claim 8 wherein said pack material is present in said carrier liquid-pack material suspension in an amount of from about 12 to about 16 pounds of pack material per gallon of carrier liquid.

10. A method of placing a gravel pack in a wellbore and in one or more perforations extending from the wellbore into a subterranean formation penetrated thereby comprising the steps of:

placing a tubular gravel pack screen in said wellbore adjacent said perforations;

pumping a slurry of a carrier liquid having a particulate solid pack material suspended therein in an amount in the range of from about 7.5 to about 33.0 pounds of pack material per gallon of carrier liquid into the annular space between the exterior of said screen and the walls of said wellbore containing said perforations whereby a gravel pack of high efficiency of said pack material is screened out of said slurry and formed in said annular space and in said perforations, said pack material having a specific gravity substantially the same as the specific gravity of said carrier liquid and at least a portion of said slurry comprises said carrier liquid in a volume in the range of from about 101% to about 120% of the available void space between touching particulate material present in said slurry; and recovering carrier liquid from said wellbore.

11. The method of claim 10 wherein said carrier liquid is selected from the group consisting of hydrocarbon liquids, aqueous solutions of sodium chloride, potassium chloride, ammonium chloride, calcium chloride, calcium bromide, zinc bromide and mixtures of such salts and oil field brines, and has a specific gravity in the range of from about 0.78 to about 2.30 at 20° C.

12. The method of claim 11 wherein said pack material is selected from one of natural organic substances or a resin selected from the group consisting of a polymer or copolymer of acrylic acid, methacrylic acid, esters of the foregoing acids and acrylonitrile, polyester, urea-formaldehyde, polyepoxide, melamine-formaldehyde and styrene-divinylbenzene, and said plastic material has a specific gravity in the range of from about 0.78 to about 2.30 at 20° C.

13. The method of claim 10 wherein said aqueous carrier liquid is brine having a specific gravity of from about 1.1 to about 1.15 at 20° C. and occupies a volume of from about 101% to about 110% of the available void space between touching particulate material.

14. The method of claim 13 wherein said pack material is a plastic material comprised of styrene-divinylbenzene resin having a specific gravity of from about 1.1 to about 1.15 at 20° C.

15. The method of claim 14 wherein said pack material is present in said carrier liquid-pack material suspension in an amount of from about 12 to about 16 pounds of pack material per gallon of carrier liquid.

16. In a method of forming a gravel pack in a horizontal wellbore wherein a gravel pack screen is placed in the wellbore adjacent one or more perforations therein and a slurry of a carrier liquid-particulate solid pack material suspension is injected into the annular space between the screen and the walls of the wellbore containing the perforations whereby a gravel pack of high efficiency of the pack material is screened out of the slurry and formed in the annular space and the perforations, the improvement which comprises:

said carrier liquid being of a low viscosity whereby said pack material is readily separated therefrom and said annular space and perforations are substantially completely filled with said pack material; and said pack material having a specific gravity substantially equal to the specific gravity of said carrier liquid whereby said pack material is present in said slurry in an amount in the range of from about 7.5 to about 33.0 pounds of pack material per gallon of carrier liquid and at least a portion of said slurry comprises said carrier liquid in a volume in the range of from about 101% to about 120% of the available void space between touching particulate material present in said slurry.

17. The method of claim 16 wherein said carrier liquid is selected from the group consisting of hydrocarbon liquids, aqueous solutions of sodium chloride, potassium chloride, ammonium chloride, calcium chloride, calcium bromide, zinc bromide, mixtures of said salts and oil field brines, and has a specific gravity in the range of from about 0.78 to about 2.30 at 20° C.

18. The method of claim 17 wherein said pack material is selected from one of natural organic substances or a resin selected from the group consisting of a polymer or copolymer of acrylic acid, methacrylic acid, esters of the foregoing acids and acrylonitrile, polyester, urea-formaldehyde, polyepoxide, melamine-formaldehyde and styrene-divinylbenzene, and said plastic material has a specific gravity in the range of from about 0.78 to about 2.30 at 20° C.

19. The method of claim 16 wherein said aqueous carrier liquid is brine having a specific gravity of about 1.13 to 20° C. and occupies a volume of from about 101% to about 110% of the available void space between touching particulate material.

20. The method of claim 19 wherein said pack material is a plastic material comprising styrene-divinylbenzene having a density of about 1.13 at 20° C.

* * * * *